US006402483B1

(12) United States Patent
Kawamura et al.

(10) Patent No.: US 6,402,483 B1
(45) Date of Patent: Jun. 11, 2002

(54) DOUBLE-HEADED PISTON COMPRESSOR

(75) Inventors: Hisato Kawamura; Noriyuki Shintoku; Motonobu Kawakami, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/594,283

(22) Filed: Jun. 15, 2000

(30) Foreign Application Priority Data

Jun. 30, 1999 (JP) ..... 11-185323

(51) Int. Cl.[7] ..... F04B 1/12; F04B 27/08
(52) U.S. Cl. ..... 417/269; 417/312; 417/540
(58) Field of Search ..... 417/269, 312, 417/540; 92/71; 181/403

(56) References Cited

U.S. PATENT DOCUMENTS

| | | | | |
|---|---|---|---|---|
| 3,380,651 A | | 4/1968 | Niki et al. | |
| 3,930,758 A | | 1/1976 | Park | 417/269 |
| 4,544,332 A | | 10/1985 | Shibuya | 417/269 |
| 4,652,217 A | * | 3/1987 | Shibuya | 417/269 |
| 4,813,852 A | | 3/1989 | Ikeda et al. | 417/269 |
| 4,880,361 A | * | 11/1989 | Ikeda et al. | 417/269 |
| 4,936,754 A | * | 6/1990 | Suzuki et al. | 417/269 |
| 5,236,312 A | * | 8/1993 | Finn et al. | 417/269 |
| 5,244,355 A | * | 9/1993 | Fujii et al. | 417/269 |
| 5,533,870 A | * | 7/1996 | Takenaka et al. | 417/269 |
| 5,800,147 A | * | 9/1998 | Arai et al. | 417/269 |
| 5,899,670 A | * | 5/1999 | Ikeda et al. | 417/312 |
| 6,077,049 A | * | 6/2000 | Nakamura et al. | 417/269 |
| 6,293,768 B1 | * | 9/2001 | Shintoku et al. | 417/312 |

FOREIGN PATENT DOCUMENTS

| | | | | |
|---|---|---|---|---|
| JP | 6-147116 | | 5/1994 | |
| JP | 10-281060 | | 10/1998 | |
| JP | 02000120532 A | * | 4/2000 | 417/269 |
| JP | 2000120532 A | * | 4/2000 | 417/269 |

* cited by examiner

*Primary Examiner*—Charles G. Freay
*Assistant Examiner*—Han L. Liu
(74) *Attorney, Agent, or Firm*—Morgan & Finnegan, LLP

(57) ABSTRACT

A double-headed piston compressor includes a pair of opposite discharge chambers. Each discharge chamber is defined by a large annular wall and a small annular wall. The annular walls are located about the axis of the drive shaft. A limit wall is formed in each housing and is located in each discharge chamber. Each limit wall extends substantially radially to connect the annular walls near the outlet of the discharge chamber. Therefore, each discharge chamber forms a gas passage, which extends circularly about the axis of the drive shaft from the limit wall to the outlet. Compressed gas discharged from the cylinder bores to each discharge chamber through the discharge ports flows in one direction toward the outlet. As a result, pulsation of compressed gas is attenuated.

17 Claims, 7 Drawing Sheets

DOUBLE-HEADED PISTON COMPRESSOR

BACKGROUND OF THE INVENTION

The present invention relates to a double-headed piston compressor for an air conditioner used in vehicles.

As shown in FIG. 7, a typical double-headed piston compressor includes front and rear cylinder blocks 101, 102, which are joined together. A front housing member 103 is attached to one end of the front cylinder block 101. A rear housing member 104 is attached to the other end of the rear cylinder block 102.

A drive shaft 105 is rotatably supported by the cylinder blocks 101, 102, and the front housing member 103. Cylinder bores 106 are formed in the cylinder blocks 101, 102. The cylinder bores 106 formed in the front cylinder block 101 correspond to those in the rear cylinder block 102. Double-headed pistons 107 are accommodated in the cylinder bores 106 and are connected the drive shaft 105 through a swash plate 108. A suction chamber 109 and a discharge chamber 110 are formed in each of the front and rear housing members 103, 104.

Rotation of the drive shaft 105 is converted into reciprocation of the pistons 107 by the swash plate 108. The pistons 107 draw refrigerant gas to the corresponding cylinder bores 106, compress the gas, and discharge the gas to the discharge chambers 110. Then, the compressed refrigerant gas is sent to an external refrigerant circuit.

Each piston 107 intermittently discharges refrigerant gas from the corresponding cylinder bore 106. The intermittent discharge of compressed gas generates pressure pulsation, which causes vibration and noise in the external refrigerant circuit. Therefore, in the compressor of FIG. 7, a muffler chamber 118 is formed on the outer circumferential portions of the cylinder blocks 101, 102. Refrigerant gas that is discharged from the front and rear discharge chambers 110 flows to the muffler chamber 118. The muffler chamber 118 attenuates the pressure pulsation of the refrigerant gas before sending the gas to the external refrigerant circuit.

In the past, attenuation of the pressure pulsation was accomplished by increasing the volume of the muffler chamber 118, which increased the size of the compressor. However, there is a need to improve the attenuation of the pressure pulsation without increasing the size of the compressor.

SUMMARY OF THE INVENTION

An objective of the present invention is to provide a double head piston compressor that can attenuate pressure pulsation of discharged gas without increasing the size of the compressor.

To achieve the above objective, the present invention provides a compressor including a drive shaft and a drive plate, which is supported by the drive shaft. A piston is coupled to the drive plate. The piston includes two opposed piston heads, and the drive plate converts rotation of the drive shaft into reciprocation of the piston. A pair of compression chambers correspond to the piston heads. A pair of discharge chambers correspond to the compression chambers. Each compression chamber is connected to a corresponding one of the discharge chambers through a respective discharge port. The piston heads compress gas in the corresponding compression chambers and discharge compressed gas from the corresponding compression chambers to the corresponding discharge chambers. Each discharge chamber has an outlet for compressed gas. A limit wall is formed in each discharge chamber. Each limit wall limits the flow of compressed gas in the corresponding discharge chamber so that compressed gas in the corresponding discharge chamber flows circularly about the axis of the drive shaft in one direction from the discharge port toward the outlet.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A double-headed piston compressor for an air conditioner used in vehicles according to one embodiment of the present invention will now be described.

Figure 1:
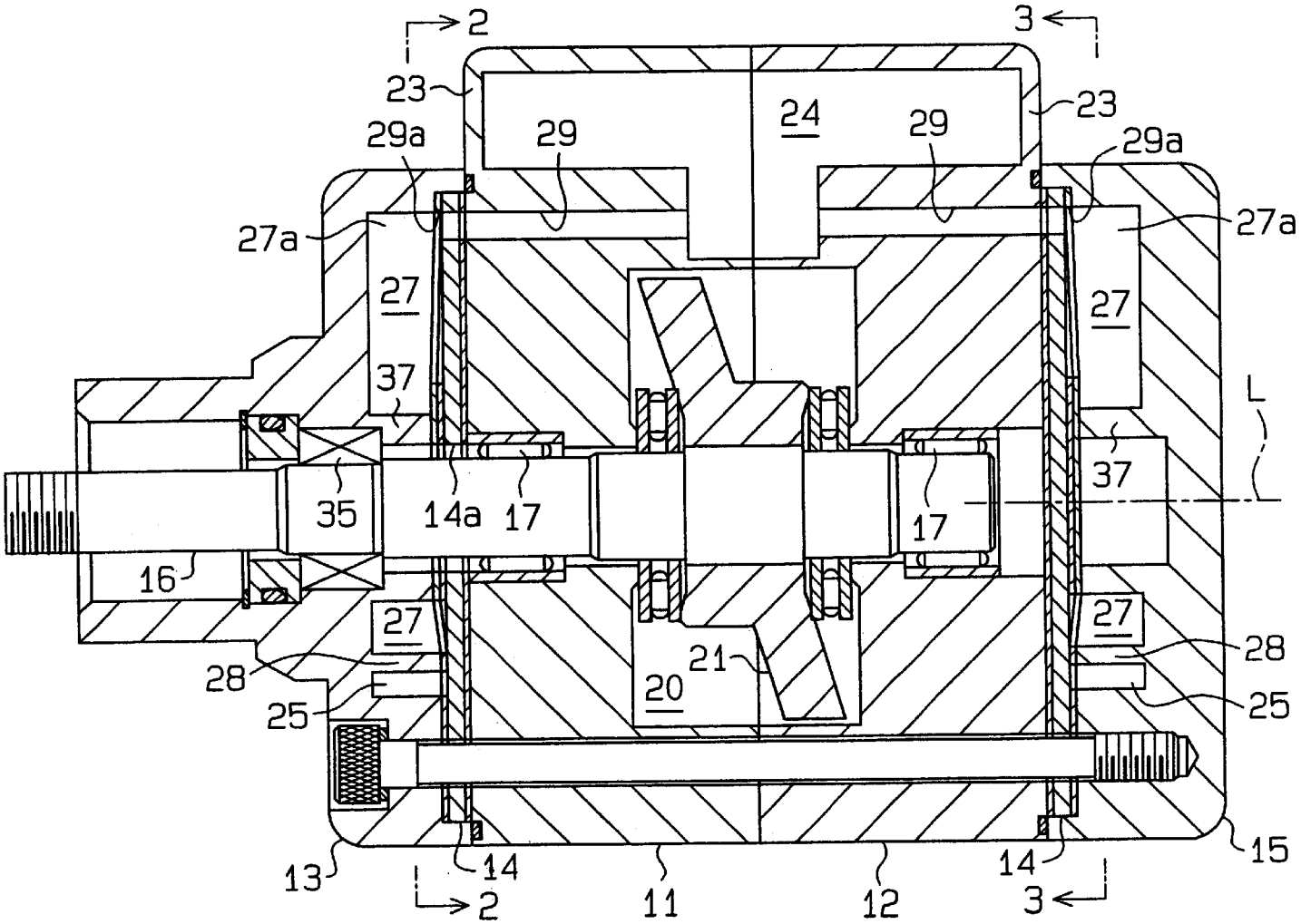
FIG. 1 is a cross-sectional view taken along line 1—1 of FIG. 3 of a double head piston compressor according to one embodiment of the present invention.
Figure 4:
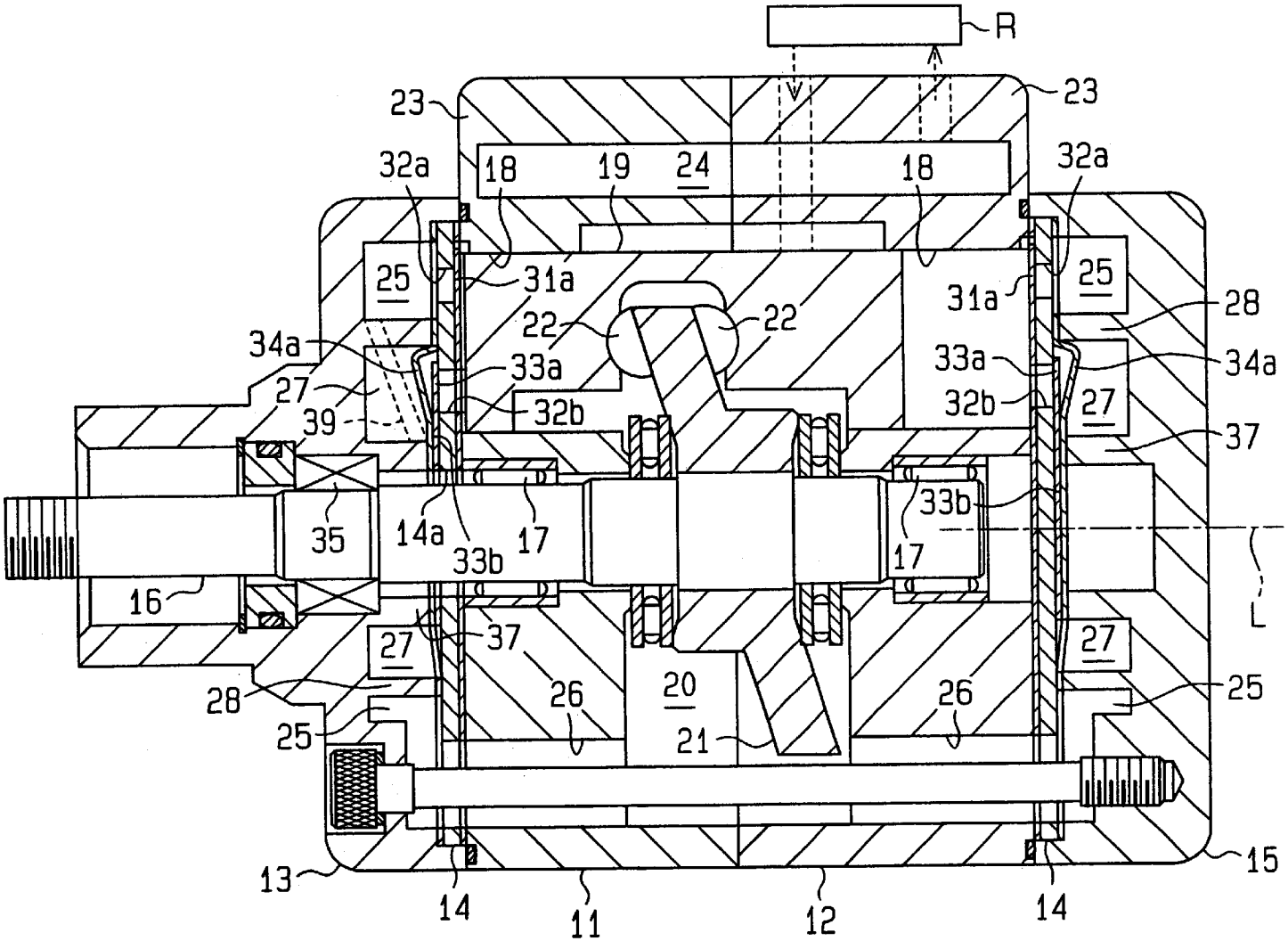
FIG. 4 is a cross-sectional view taken along line 4—4 of FIG. 3.

As shown in FIGS. 1 and 4, front and rear cylinder blocks 11, 12 are assembled. A front housing member 13 is attached to the front end of the front cylinder block 11 through a front valve plate assembly 14. The rear housing member 15 is attached to the rear end of the rear cylinder block 12 through a rear valve plate assembly 14.

Each of the cylinder blocks 11, 12, and the housing members 13, 15 forms a housing element. The front cylinder block 11 and the front housing member 13 form a front housing assembly, and the rear cylinder block 12 and the rear housing member 15 form a rear housing assembly.

A drive shaft 16 is supported by the cylinder blocks 11 and 12 through a pair of radial bearings 17. The front end of the drive shaft 16 passes through the front housing member 13 and extends outward. The drive shaft 16 is coupled to and is driven by an external drive source such as a vehicle engine (not shown). A shaft seal 35, which is located between the front housing member 13 and the drive shaft 16 prevents leakage of refrigerant gas from the front housing member 13.

Cylinder bores 18 (five in this embodiment) are formed in each cylinder block 11, 12. The cylinder bores 18 of each cylinder block 11, 12 are parallel to and are equally spaced from the axis L of the drive shaft 16 and they are angularly spaced at equal intervals from one another. The cylinder bores 18 of the front cylinder block 11 are symmetrical to those of the rear cylinder block 12 about a plane that is perpendicular to the drive shaft 16. A double-headed piston 19 is located in each aligned pair of cylinder bores 18. A compression chamber is defined in each cylinder bore between the corresponding piston 19 and the corresponding valve plate assembly 14. Accordingly, the compressor has ten compression chambers.

A crank chamber 20 is formed between the front and rear cylinder blocks 11 and 12. A drive plate, which is a swash plate 21, is fixed to the drive shaft 16 in the crank chamber 20. Each piston 19 is coupled to the periphery of the swash plate 21 through a pair of shoes 22. Rotation of the drive shaft 16 is converted into reciprocation of the pistons 19 through the swash plate 21 and the shoes 22.

Muffler housing members 23 are respectively formed on the outer circumferential portions of the cylinder blocks 11, 12 as shown in FIG. 1. Each muffler housing member 23 is open to the other muffler housing member 23. When the cylinder blocks 11, 12 are joined, the muffler housing members are joined, which forms a muffler chamber 24.

Figure 2:
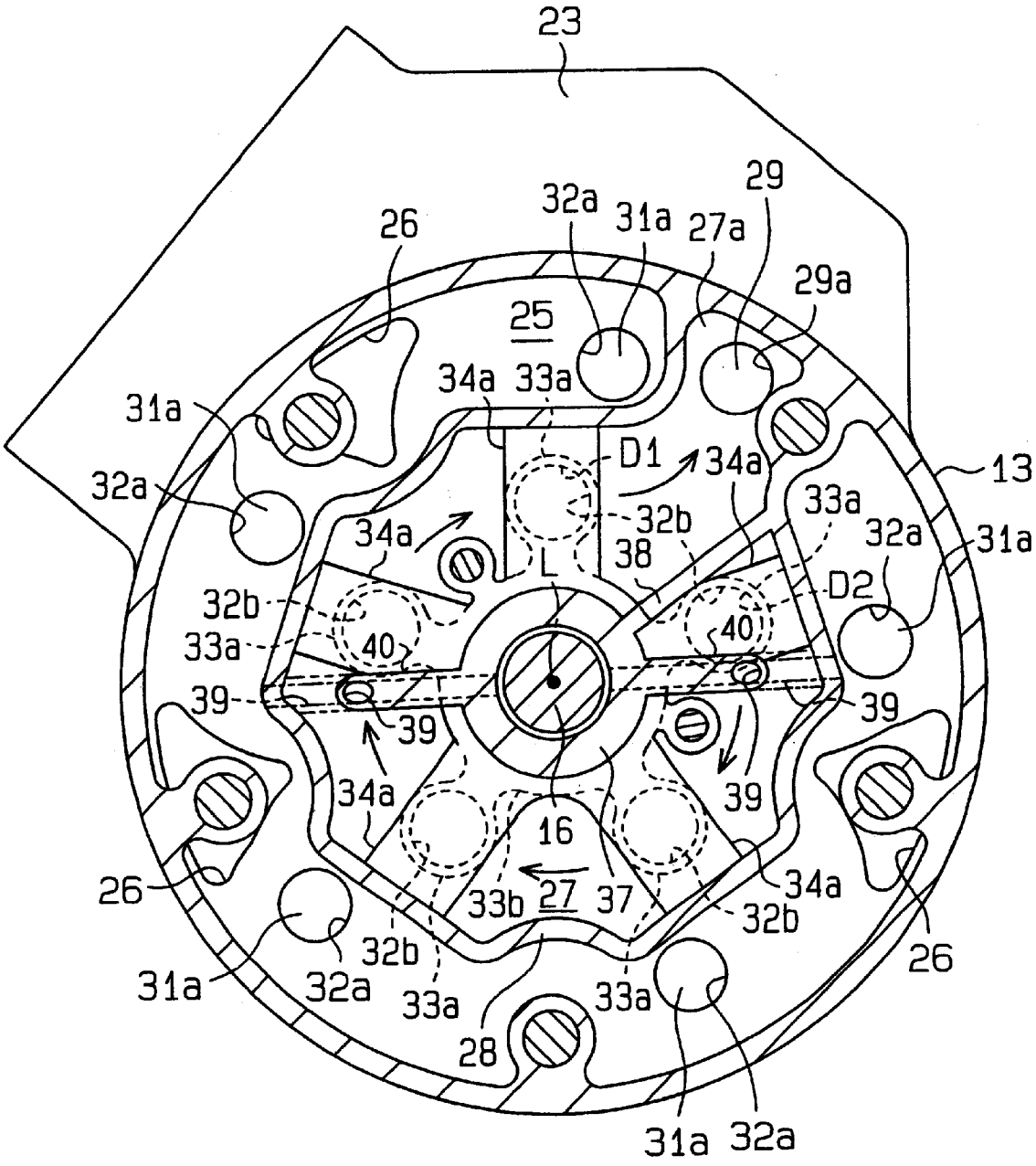
FIG. 2 is a cross-sectional view taken along line 2—2 of FIG. 1.
Figure 3:
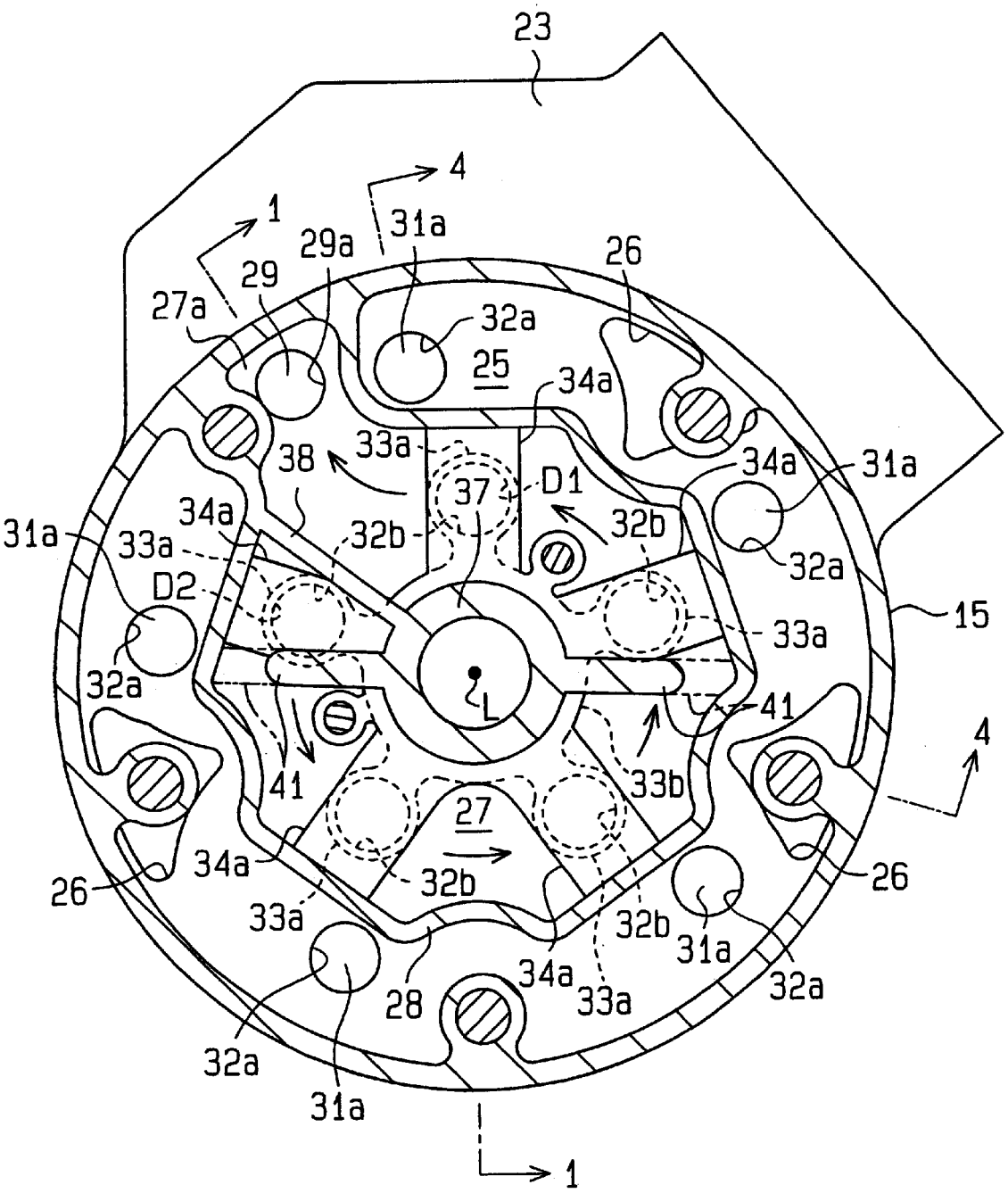
FIG. 3 is a cross-sectional view taken along line 3—3 of FIG. 1.

As shown in FIGS. 2 and 3, a discharge chamber 27 is formed in each housing member 13, 15. A suction chamber 25 is formed in each housing member 13, 15 to surround the corresponding discharge chamber 27. The suction chambers 25 are connected to the crank chamber 20 through suction passages 26 (see FIG. 4). Each housing member 13, 15 has a generally annular partition 28, which separates the corresponding suction chamber 25 from the corresponding discharge chamber 27.

As shown in FIGS. 2 and 3, each partition 28 is connected to the peripheral wall of the corresponding housing member 13, 15. As a result, part of each discharge chamber 27 extends to the peripheral wall of the corresponding housing member 13, 15. The peripheral part of each discharge chamber 27 forms a communication chamber 27*a*. Each communication chamber 27*a* is connected to the muffler chamber 24 through the corresponding discharge passage 29 (see FIG. 1). The front and rear communication chambers 27*a* are symmetrical and are generally aligned along a line that is parallel to the axis L of the drive shaft 16. Each of the discharge passages 29 has an entrance 29*a*. Each entrance 29*a* serves as an outlet of the corresponding communication chamber 27*a*, that is, the discharge chamber 27. The discharge passages 29 are aligned and are parallel to the axis L of the drive shaft 16.

As shown in FIG. 4, the crank chamber 20 is connected with the muffler chamber 24 through an external refrigerant circuit R. The external refrigerant circuit R includes a condenser, an evaporator, an expansion valve and the like (none shown). The external refrigerant circuit R and the compressor form the refrigeration circuit for the air conditioner.

Figure 5:
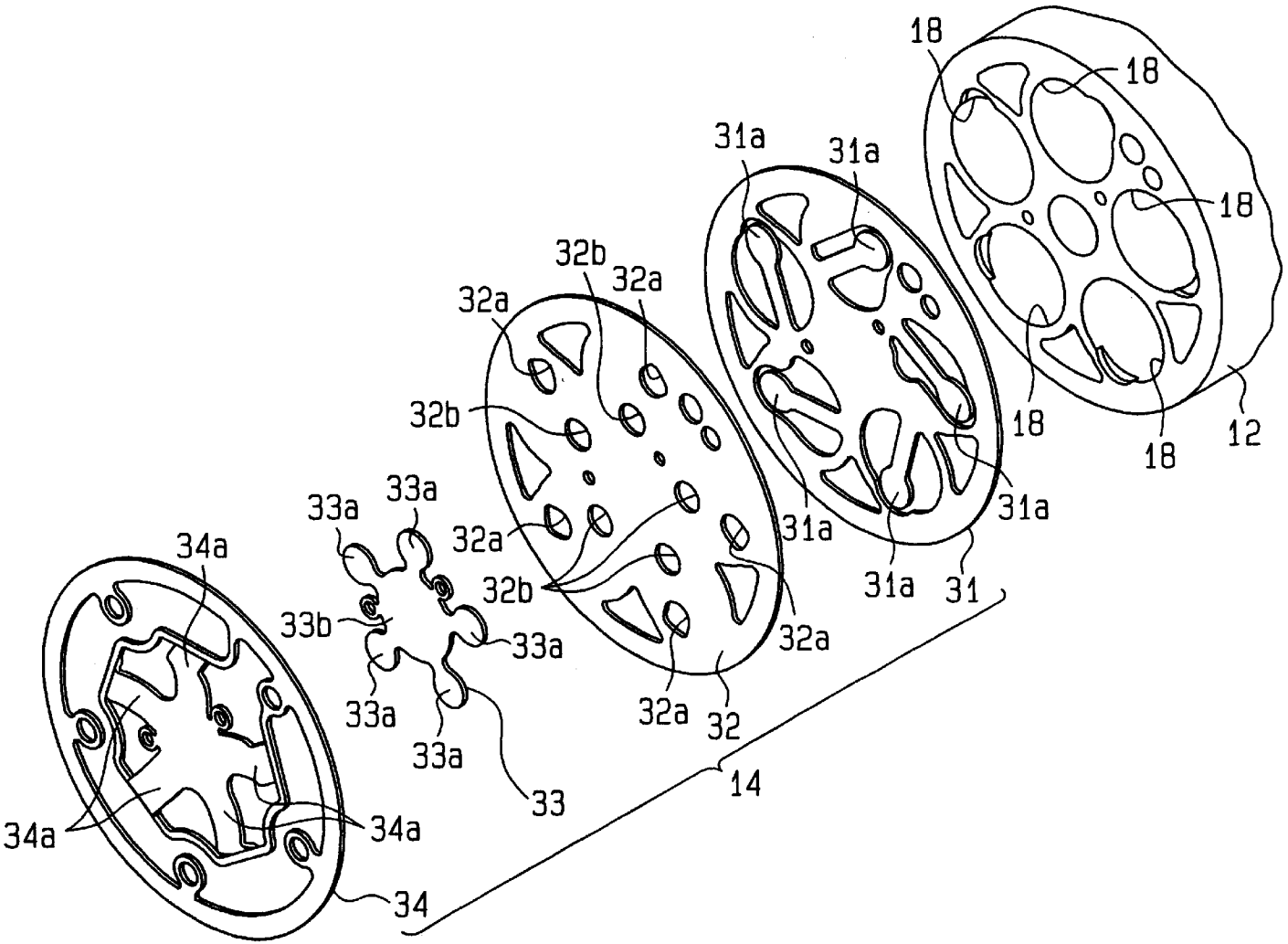
FIG. 5 is an exploded view of a valve plate assembly.

As shown in FIG. 5, each valve plate assembly 14 includes a suction valve plate 31, a port plate 32, a discharge valve plate 33, and a retainer plate 34. The plates 31 to 34 are axially arranged in order from the corresponding cylinder block 11, 12 to the corresponding housing member 13, 15. FIG. 5 shows the rear valve plate assembly 14. The front valve plate assembly 14 includes a through hole 14*a* (see FIG. 1). The drive shaft 16 passes the through hole 14*a*. The front valve plate assembly 14 is the same as the rear valve plate assembly 14 except for the through hole 14*a*.

Each port plate 32 includes suction ports 32*a*, which corresponds to five cylinder bores 18. Each suction port 32*a* connects the corresponding cylinder bore 18 with the nearest suction chamber 25. Suction valves 31*a*, which are reed valves, are formed in each suction valve plate 31 to correspond to the suction ports 32*a*. Each port plate 32 also includes discharge ports 32*b*, which correspond to the cylinder bores 18. The discharge ports 32*b* connect the corresponding cylinder bores 18 with the nearest discharge chamber 27. Discharge valves 33*a*, which are reed valves, are formed by the discharge valve plates 33 to correspond to the discharge ports 32*b*.

Each discharge valve plate 33 includes a base disc 33*b*. The discharge valves 33*a* extend radially from the base disc 33*b*. Each retainer plate 34 includes retainers 34*a*, which correspond to the discharge valves 33*a*. The retainers 34*a* determine the maximum opening amount of the corresponding discharge valves 33*a*.

As shown in FIGS. 1–4, annular walls 37 are centered on the axis L of the drive shaft 16 and extend from the inner walls of the housing members 13, 15 to the valve plate assembly 14. The discharge chambers 27 are formed between the annular walls 37 and the partitions 28.

When the housing members 13, 15 are coupled to the corresponding cylinder blocks 11, 12 through the valve plate assemblies 14, the annular walls 37 are pressed against the central part of the valve plate assemblies 14, that is, the central part of the retainer plates 34. Accordingly, the central parts of the valve plate assemblies 14 are pressed between the annular walls 37 and the cylinder blocks 11, 12. The outer diameter of the annular walls 37 is slightly smaller than that of the base disc 33*b* of the discharge valve plate 33. Accordingly, the base disc 33*b* is firmly fixed between the port plate 32 and the retainer plate 34.

The drive shaft 16 passes through the annular wall 37 of the front housing member 13. The annular walls 37 are pressed against the valve plate assemblies 14 and separate the discharge chambers 27 from the space inside the annular walls 37.

When the pistons 19 are rotated by the rotation of the drive shaft 16, refrigerant gas is drawn from the suction chambers 25 to the cylinder bores 18 through the corresponding suction ports 32*a* and suction valves 31*a*. Then, the refrigerant gas in the cylinder bores 18 is compressed and discharged to the discharge chambers 27 through the corresponding discharge ports 32*b* and discharge valves 33*a*.

Compressed refrigerant gas flows from the discharge chambers 27 to the muffler chamber 24 through the corresponding communication chambers 27*a* and discharge passages 29. The muffler chamber 24 attenuates the pressure pulsation of the compressed refrigerant gas and sends the gas to the external refrigerant circuit R. This limits noise and vibration caused by the pressure pulsation.

The structure of the present embodiment will now be described. As shown in FIGS. 2 and 3, limit walls 38 are formed on the front and rear housing members 13, 15. The limit walls 38 connect the annular walls 37 to the partitions 28. The limit walls 38 extend radially from the axis L. The limit wall 38 of the front housing member 13 and the limit wall 38 of the rear housing member 15 are mirror images of one another and lie in the same plane.

Two adjacent discharge ports 32*b* near the communication chambers 27*a* will be designated as D1 and D2. Each limit wall 38 is located between the discharge ports D1 and D2. The discharge port D2 is located on the opposite side of the limit wall 38 from the communication chamber 27*a*. The gas passage from the discharge passage D2 to the communication chamber 27*a* is longer than that from the other discharge ports 32*b* to the communication chamber 27*a*. Each discharge chamber 27 extends circularly from the vicinity of the limit wall 38 toward the communication chamber 27*a*. The five discharge ports 32*b* are arranged in the direction in which the corresponding discharge chambers 27 extend. Accordingly, refrigerant gas discharged from the five discharge ports 32*b* to the discharge chamber 27 flows in the same direction along the annular wall 37 toward the communication chamber 27*a*. The flow directions in the front and rear discharge chambers 27 are the same.

The front and rear discharge chambers 27 are symmetrical and have the same volume. The front and rear discharge ports 32*b* form aligned pairs, each of which corresponds to one of the pistons 19. The distances from the discharge ports 32*b* of an aligned pair to the entrances 29*a* of the discharge passages 29 are the same. The discharge passages 29 are symmetrical and the dimensions are the same. Accordingly, the gas passages from each aligned pair of discharge ports 32*b* to the muffler chamber 24 are the same.

As shown in FIGS. 2 and 4, a pair of oil supply passages 39 are formed in the front housing member 13. The oil supply passages 39 connect the front suction chamber 25 with the internal space of the front annular wall 37. Each oil supply passage 39 extends from the suction chamber 25 toward the drive shaft 16 and passes through the front discharge chamber 27. The oil supply passages 39 are formed in radial walls 40, which extend from the inner wall of the discharge chamber 27. Each radial wall 40 passes through the front discharge chamber 27 but does not partition the front discharge chamber 27. That is, gas can flow between the radial wall 40 and the valve plate assembly 14.

If the oil supply passages 39 are formed to go around the discharge chamber 27, manufacturing the oil supply passages 39 would be difficult and the front housing member would require enlargement to accommodate the oil supply passages 39, which would increase the size of the compressor. However, in the present embodiment, the oil supply passages 39 are straight and pass through the discharge chamber 27, which facilitates manufacturing the oil supply passages 39 and reduces the size of the compressor. Refrigerant gas including atomized oil is supplied to the vicinity of the seal 35 from the front suction chamber 25 through the oil supply passages 39. Oil included in refrigerant gas lubricates and cools the seal 35.

The radial walls 40 of FIG. 2 need not be formed in the rear housing member 15, which does not require the oil supply passages 39. However, as shown in FIG. 3, the rear housing member 15 includes dummy radial walls 41 that are the same as the front radial walls 40, which makes the front and rear discharge chambers 27 identical. The dummy walls 41 and the front radial walls 40 are symmetrical about a plane that is perpendicular to the axis L.

Dimensional errors in the discharge chambers 27 that occur during the manufacturing step can be ignored as long as the dimensional errors are within a tolerance range. Even if the front and rear discharge chambers 27 are not completely identical, they are regarded as symmetrical as long as the dimensional errors are within a tolerance range.

The operation of the present embodiment will now be described. Since the front and rear discharge chambers 27 are symmetrical in the present embodiment, the wave forms of the pressure pulsation of the front and rear discharge chambers 27 are the same. When the compression stroke is performed by one of the pistons 19 in one of the front cylinder bores 18, a suction stroke is performed in the corresponding rear cylinder bore 18. Therefore, the wave form of the pressure pulsation of the front discharge chamber 27 opposite in phase to that of the rear discharge chamber 27.

Compressed gas in the discharge chambers 27 flows to the muffler chamber 24 through the symmetrical discharge passages 29. Accordingly, the oppositely phased components of the pressure pulsation cancel one another, which reduces the pressure pulsation of the refrigerant gas.

The discharge chambers 27 extend circularly from the vicinity of the limit walls 38 toward the communication chambers 27*a*. Accordingly, refrigerant gas discharged from the five discharge ports 32*b* to the corresponding discharge chamber 27 flows in the same direction along the annular walls 37 toward the communication chambers 27*a*.

The radial walls 40 formed in the front discharge chamber 27 greatly vary the cross-sectional area of the gas passage formed in the front discharge chamber 27. Also, the dummy walls 41 formed in the rear discharge chamber 27 substantially vary the cross-sectional area of the gas passage formed in the rear discharge chamber 27. The front radial walls 40 and the dummy walls 41 improve the muffling function of the discharge chambers 27, which increases the attenuation of the pressure pulsation.

Figure 6:
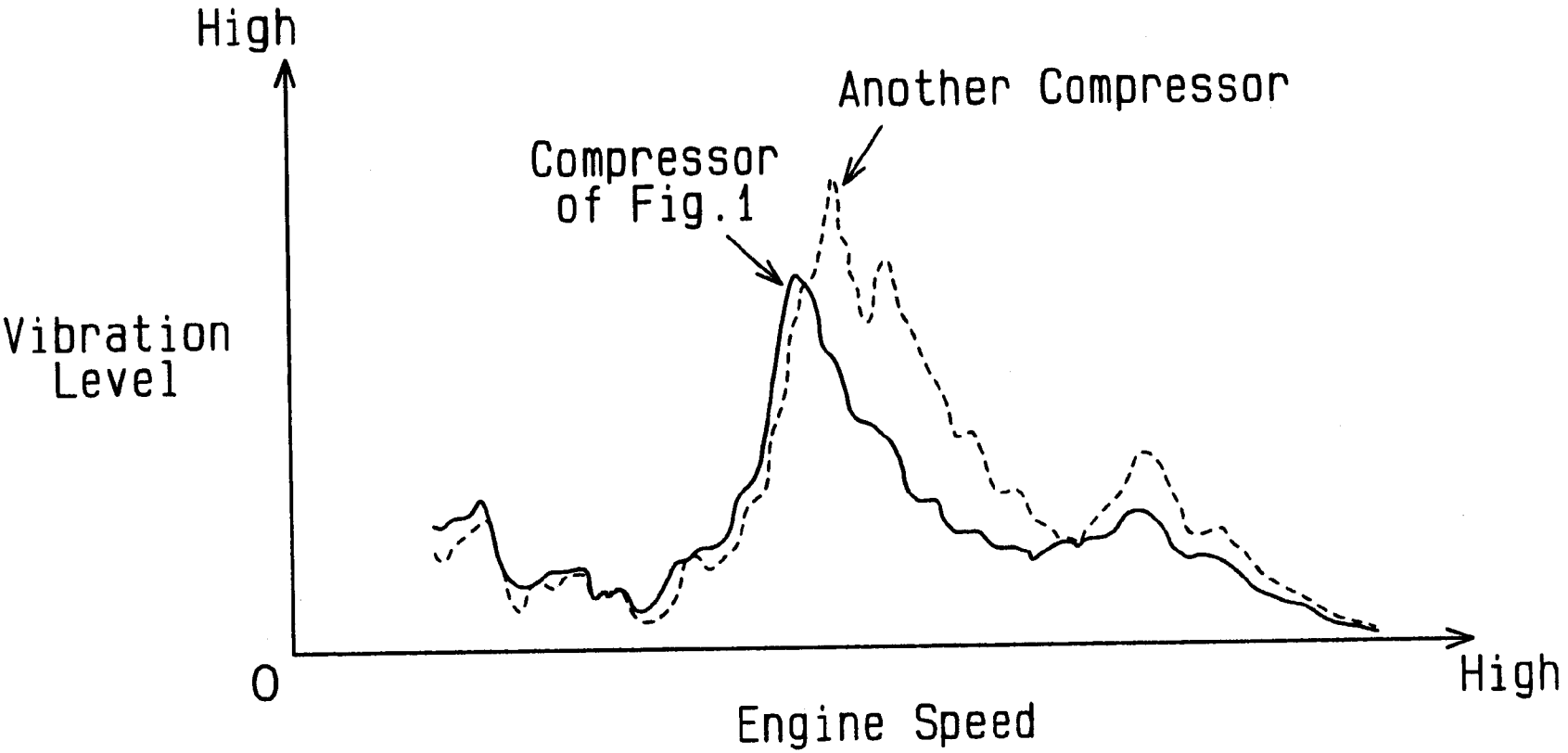
FIG. 6 is a graph illustrating the attenuation of the pressure pulsation in the compressor of FIG. 1.
Figure 7:
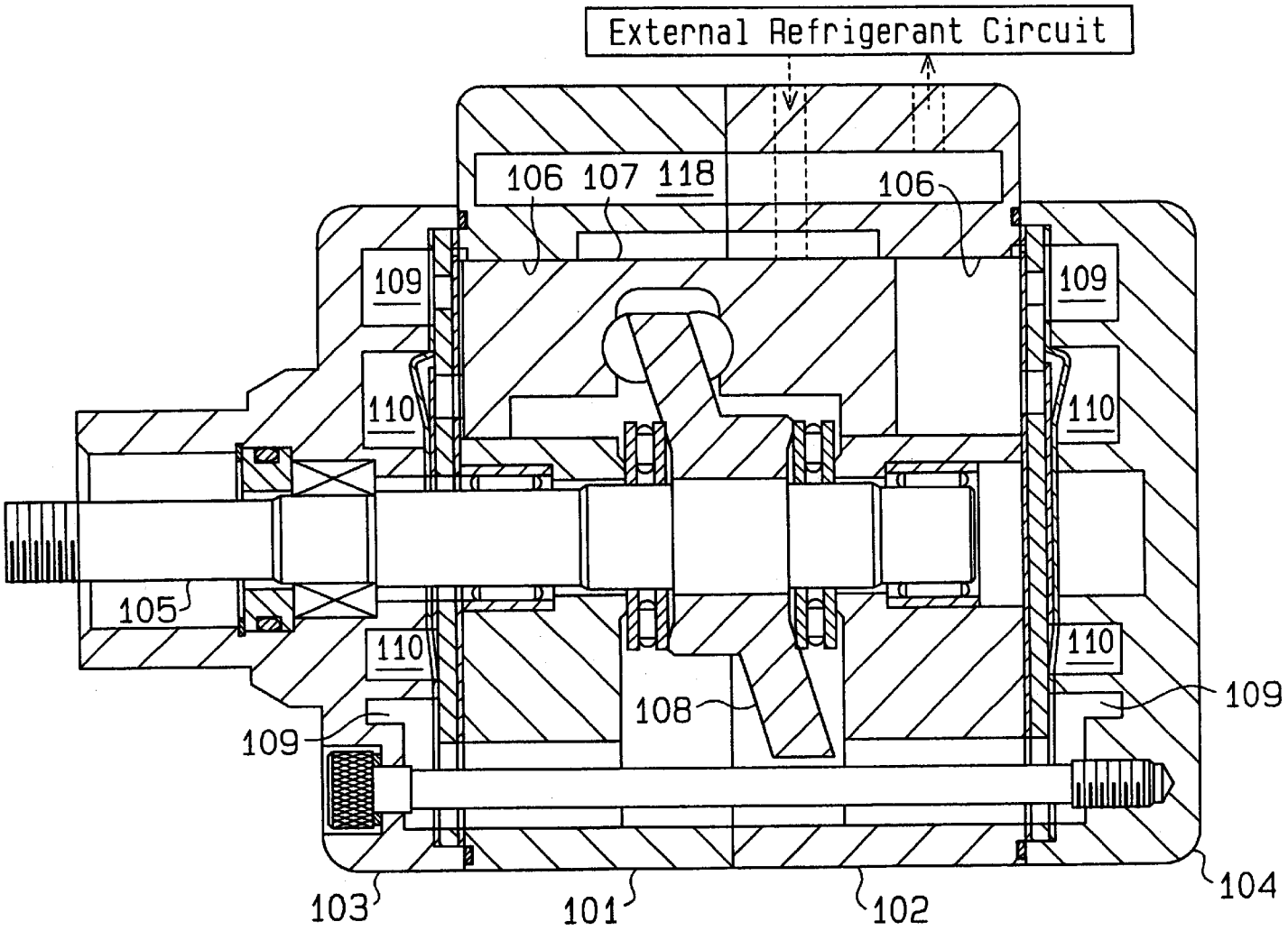
Fig.7 (Prior Art)
FIG. 7 is a cross-sectional view of a prior art double head piston compressor.

FIG. 6 is a graph showing a comparison between the attenuation of the pressure pulsation of the compressor of FIG. 1 and that of another compressor. In the graph, the solid line represents the compressor of FIG. 1, and the broken line represents another compressor. The another compressor differs from the compressor of FIG. 1 in that the compressor does not include the limit walls 38.

The frequency of the pressure pulsation of the discharged gas is determined by the engine speed of the engine that drives the compressor. When the engine speed reaches a certain level, the frequency of the pulsation approaches the natural frequency of the pipes of the external refrigerant circuit. As a result, the pipes resonate, and the vibration level of the pipes acutely increases as shown in FIG. 6. However, in the compressor of the present embodiment, the peak of the vibration level is limited compared to that of the another compressor.

In the present embodiment, the pulsation of discharged gas is efficiently attenuated without increasing the size of the compressor.

The muffler chamber 24 is formed by joining the muffler housing members 23, which are formed on the separate cylinder blocks 11, 12, respectively. In other words, the muffler chamber 24 is formed when the front and rear cylinder block 11 and 12 are assembled. Accordingly, there is no need for separate parts for forming the muffler chamber 24 and another assembly step, which reduces the manufacturing costs.

It should be apparent to those skilled in the art that the present invention may be embodied in many other specific forms without departing from the spirit or scope of the invention. Particularly, it should be understood that the invention may be embodied in the following forms.

The present invention may be applied to other types of compressors such a double-headed piston compressor with a wave cam plate that serves as a drive plate.

The muffler chamber 24 may be formed at other parts of the compressor. For example, the muffler chamber 24 may be located between the front housing member 13 and the front cylinder block 11 or between the rear cylinder block 12 and the rear housing member 15.

Therefore, the present examples and embodiments are to be considered as illustrative and not restrictive and the invention is not to be limited to the details given herein, but may be modified within the scope and equivalence of the appended claims.

What is claimed is:

1. A compressor comprising:

a drive shaft;

a drive plate, which is supported by the drive shaft;

a plurality of pistons, which are arranged about the axis of the drive shaft and are coupled to the drive plate, wherein each piston includes two opposed piston heads, and the drive plate converts rotation of the drive shaft into reciprocation of each piston;

a plurality of pairs of compression chambers, wherein each pair of compression chambers correspond to the piston heads of one of the pistons;

a pair of discharge chambers, wherein each discharge chamber corresponds to one of each pair of compression chambers, wherein each compression chamber is connected to a corresponding one of the discharge chambers through a respective discharge port, wherein the piston heads of each piston compress gas in the corresponding compression chambers and discharge compressed gas from the corresponding compression chambers to the corresponding discharge chambers, wherein each discharge chamber has an outlet for compressed gas; and a limit wall formed in each discharge chamber, wherein each limit wall limits the flow of compressed gas in the corresponding discharge chamber so that compressed gas in the corresponding discharge chamber flows circularly about the axis of the drive shaft in one direction from all the corresponding discharge ports toward the outlet.

2. The compressor according to claim 1, wherein each discharge chamber forms a gas passage, which extends circularly about the axis of the drive shaft from the corresponding limit wall toward the corresponding outlet.

3. The compressor according to claim 2, wherein each discharge chamber is defined between a large diameter annular wall and a small diameter annular wall, wherein the annular walls are centered about the axis of the drive shaft, and each limit wall extends substantially in a radial direction to connect the annular walls in the vicinity of the outlet.

4. The compressor according to claim 2, wherein the discharge ports open to the corresponding discharge chambers such that the discharge ports are arranged along the gas passage.

5. The compressor according to claim 1, wherein the outlets and the limit walls of the discharge chambers are symmetrical with respect to a plane perpendicular to the axis of the drive shaft.

6. The compressor according to claim 1, wherein the shape and the size of the discharge chambers are the same, and the compressor further includes:

a gas receiving chamber, which receives compressed gas sent from the discharge chambers;

a pair of discharge passages, which connect the discharge chambers with the gas receiving chamber, wherein the lengths of the discharge passages are the same.

7. The compressor according to claim 6, wherein the receiving chamber is a muffler chamber, which attenuates pulsation of compressed gas.

8. The compressor according to claim 7 further including two housing elements, which are joined together when the compressor is assembled, and two muffler housings, one of which is integrally formed on each housing element, wherein the muffler housings are joined to form the muffler chamber when the compressor is assembled.

9. The compressor according to claim 1 further including:

a pair of suction chambers, which are respectively located around the discharge chambers, wherein each piston head draws gas that contains lubricant oil from the corresponding suction chamber to the corresponding compression chamber;

a shaft seal, which is located around the drive shaft to prevent leakage of gas along the drive shaft;

an oil supply passage, which extends from one of the suction chambers to the vicinity of the shaft seal through the corresponding discharge chamber;

a passage member, which is located in one of the discharge chambers, wherein the oil supply passage is defined in the passage member; and a dummy member, which is located in the other of the discharge chambers, wherein the dummy member is symmetrical with the passage member.

10. A compressor comprising:

first and second housing elements that are joined together, wherein the first housing element includes a plurality of first cylinder bores, the second housing element includes a plurality of second cylinder bores, and the first cylinder bores are paired with the second cylinder bores;

a drive shaft, which is supported by the housing elements;

a drive plate, which is supported by the drive shaft;

a plurality of pistons, which are arranged about the axis of the drive shaft and are coupled to the drive plate, wherein each piston is located in one of the pairs of first and second cylinder bores and each piston includes first and second heads, wherein the drive plate converts rotation of the drive shaft into reciprocation of the pistons;

a pair of discharge chambers, which are respectively formed in the housing elements, wherein each cylinder bore is connected to a corresponding one of the discharge chambers through a respective discharge port, wherein each piston head compresses gas in the corresponding cylinder bore and discharges compressed gas from the cylinder bore to the corresponding discharge chamber through the corresponding discharge port, wherein each discharge chamber includes an outlet;

a large diameter annular wall and a small diameter annular wall, which are formed in each housing element to define each discharge chamber, wherein the annular walls are formed about the axis of the drive shaft; and a limit wall, which is formed in each housing element, wherein each limit wall is located in a corresponding one of the discharge chambers, wherein each limit wall extends substantially in a radial direction to connect the annular walls near the outlet, wherein each discharge chamber forms a gas passage, which circularly extends about the axis of the drive shaft from the corresponding limit wall toward the corresponding outlet.

11. The compressor according to claim 10, wherein the discharge ports open to the corresponding discharge chambers such that the discharge ports are arranged along the gas passage.

12. The compressor according to claim 10, wherein the outlets and the limit walls of the discharge chambers are symmetrical with respect to a plane perpendicular to the axis of the drive shaft.

13. The compressor according to claim 10, wherein the shape and the size of the discharge chambers are the same, and the compressor further includes:

a gas receiving chamber, which receives compressed gas sent from the discharge chambers;

a pair of discharge passages, which connects the discharge chambers to the gas receiving chamber, wherein the lengths of the discharge passages are the same.

14. The compressor according to claim 13, wherein the gas receiving chamber is a muffler chamber, which attenuates pulsation of compressed gas.

15. The compressor according to claim 14 further including two muffler housings, one of which is integrally formed on each housing element, wherein the muffler housings are joined and form the muffler chamber when the housing elements are joined together during assembly of the compressor.

16. The compressor according to claim 10 further including:

a pair of suction chambers, which are respectively formed in the housing elements, wherein each suction chamber is located around the corresponding discharge chamber, wherein each piston head draws gas that contains lubricant oil from the corresponding suction chamber to the corresponding cylinder bore;

a shaft seal, which is located between the first housing element and the drive shaft to prevent leakage of gas along the drive shaft;

an oil supply passage, which extends from the suction chamber of the first housing element to the vicinity of the shaft seal through the corresponding discharge chamber;

a passage member, which is located in the discharge chamber in the first housing element, wherein the oil supply passage is defined in the passage member; and a dummy member, which is located in the discharge chamber in the second housing element, wherein the dummy member is symmetrical with the passage member.

17. A compressor comprising:

a drive shaft;

a drive plate, which is supported by the drive shaft;

a piston, which is coupled to the drive plate, wherein the piston includes two opposed piston heads, and the drive plate converts rotation of the drive shaft into reciprocation of the piston;

a pair of compression chambers, which correspond to the piston heads;

a pair of discharge chambers, which correspond to the compression chambers, wherein each compression chamber is connected to a corresponding one of the discharge chambers through a respective discharge port, wherein the piston heads compress gas in the corresponding compression chambers and discharge compressed gas from the corresponding compression chambers to the corresponding discharge chambers, wherein each discharge chamber has an outlet for compressed gas;

a large diameter annular wall and a small diameter annular wall, which define each discharge chamber, wherein the annular walls are centered about the axis of the drive shaft; and a limit wall formed in each discharge chamber, wherein each limit wall extends substantially in a radial direction to connect the annular walls in the vicinity of the outlet, wherein each discharge chamber forms a gas passage, which extends circularly about the axis of the drive shaft from the corresponding limit wall toward the corresponding outlet.

* * * * *